US008715481B2

(12) United States Patent
Otsuka

(10) Patent No.: US 8,715,481 B2
(45) Date of Patent: May 6, 2014

(54) APPARATUS AND METHOD FOR ELECTROPLATING

(75) Inventor: Hiroo Otsuka, Fukuyama (JP)

(73) Assignee: Otsuka Kinzoku Kabushiki Kaisha (JP)

( * ) Notice: Subject to any disclaimer, the term of this patent is extended or adjusted under 35 U.S.C. 154(b) by 176 days.

(21) Appl. No.: 13/330,181

(22) Filed: Dec. 19, 2011

(65) Prior Publication Data

US 2012/0217164 A1 Aug. 30, 2012

(30) Foreign Application Priority Data

Feb. 24, 2011 (JP) ..... 2011-038199

(51) Int. Cl.
*C25D 5/02* (2006.01)
*B23H 11/00* (2006.01)

(52) U.S. Cl.
USPC ..... 205/134; 204/275

(58) Field of Classification Search
USPC ..... 204/275.1; 205/134
See application file for complete search history.

(56) References Cited

U.S. PATENT DOCUMENTS

| | | | | |
|---|---|---|---|---|
| 2,851,044 A * | 9/1958 | Davis | 134/76 |
| 3,951,772 A * | 4/1976 | Bick et al. | 204/198 |
| 4,280,882 A * | 7/1981 | Hovey | 205/50 |
| 4,851,098 A * | 7/1989 | Kimura et al. | 204/198 |

FOREIGN PATENT DOCUMENTS

| | | | |
|---|---|---|---|
| JP | 57-51286 | 3/1982 | |
| JP | 62-141072 | 9/1987 | |
| JP | 5-93292 | 4/1993 | |
| JP | 2007-023348 | 2/2007 | |
| JP | 2008-297082 | * 12/2008 | B65G 17/20 |
| JP | 2010-043292 | 2/2010 | |

* cited by examiner

*Primary Examiner* — Keith Hendricks
*Assistant Examiner* — Stefanie Wittenberg
(74) *Attorney, Agent, or Firm* — Merek, Blackmon & Voorhees, LLC

(57) ABSTRACT

A processed product is continuously partially plated without being covered. Electroplating is carried out on a portion other than a head of a processed product also having a lower part and a constricted part between the head and the lower part. A pair of rails has an opening between the rails narrower than the head and broader than the constricted part, and electrodes are arranged thereon. A plating bath is positioned below the rails, and electrode plates are arranged in a plating solution. The constricted part of the processed product is positioned at the opening between the rails, and a pushing element extending from above the rails through the opening contacts the processed product at a position lower than the center of gravity at the lower part. The pushing element is displaced along the rails to plate a portion of the processed products positioned below the rails.

2 Claims, 3 Drawing Sheets

APPARATUS AND METHOD FOR ELECTROPLATING

CROSS-REFERENCE TO RELATED APPLICATION

The present application claims the priority under 35 U.S.C. 119 of Japanese Application No. 2011-038199, filed Feb. 24, 2011, which is hereby incorporated herein by reference in its entirety.

BACKGROUND OF THE INVENTION

1. Field of the Invention

The present invention relates to electroplating apparatus. More particularly, the invention relates to an electroplating apparatus that electrochemically deposits plated metal on a plating portion of a processed product having a supported face portion above the plating portion and the center of gravity.

2. Description of the Related Art

In electroplating, partial plating to deposit metal on a partial range is disclosed in, for example, Japanese Unexamined Patent Application Publication No. 5-93292 and Japanese Unexamined Patent Application Publication 2010-43292. In Japanese Unexamined Patent Application Publication No. 5-93292, a plurality of processed products is simultaneously hung on cathodic bar electrodes, and the position of the processed products is maintained so that only the plating range is soaked in electrolyte.

In Japanese Unexamined Patent Application Publication 2010-43292, plating is carried out by coating a processed product with a self-assembled film that constitutes an insulating layer on a conductive substrate subject to plating, then continuously carrying in the electrolyte. In this case, only a portion other than the self-assembled film is plated.

Japanese Unexamined Utility Model Application Publication No. 62-141072 discloses an electroplating apparatus, wherein a cylindrical plated object is guided in electrolyte. In this case, the plated object is loaded on rails, and a pin moving on an endless track is inserted in grooves of the rails through the cylinder of the object. The rails have electrodes to contact the plated object thereon. Instead of the pin, a hook can be used.

SUMMARY OF THE INVENTION

Problems to be Solved by the Invention

According to a technique in Japanese Unexamined Patent Application Publication No. 5-93292, because the processed object is positioned in plating solution, the field intensity from a fixed electrode varies according to the position of the processed object in the plating solution. Therefore, it is easy for unevenness to occur in the quality of plate.

According to a technique in Japanese Unexamined Patent Application Publication 2010-43292, because the conductive substrate subject to plating moves in the plating solution, it is possible to prevent unevenness in the quality caused by the position of the electrode. However, operating performance is reduced, because it takes time to form the self-assembled film on the conductive substrate.

According to a technique in Japanese Unexamined Utility Model Application Publication No. 62-141072, soaking in the plating solution the electrodes contacting the plated object is a factor causing the deposited surface to be rough at the position where the plated object is slid on the electrode.

Besides, it is necessary to limit the material to avoid plating adhesion on the electrode itself. In addition, since the whole plated object is soaked in the plating solution, there is no consideration of a portion that avoids plating adhesion in partial plating.

It is therefore an object of the present invention to provide an electroplating apparatus to keep the quality from varying and to enable partial plating to be carried out continuously.

In another aspect, the present invention is directed to a method of electroplating that electrochemically deposits plated metal on a plating portion of a processed product having a supported face portion above the plating portion and the center of gravity.

Means of Solving the Problems

To solve the above-mentioned problems, an electroplating apparatus that electroplates a portion of a processed product other than an upper part above a constricted part of the processed product includes a pair of rails, a plating bath, a feeder device and pushing elements. The processed product has a head over the constricted part and a center of gravity under the constricted part. The pair of rails has electrodes and a spacing between rails narrower than the head and wider than the constricted part. The plating bath is positioned below the rails and has electrode plates in plating solution. The feeder device arranges the processed product so that the constricted part is positioned in the space between the rails, and the head and the lower part below the constricted part are positioned over and under the rails, respectively. The pushing elements pass through the space between the rails from above the rails and slide the processed products on the rails in a contact manner with the electrodes by pushing each processed product at a position below the center of gravity of the processed product.

Effects of the Invention

With the electroplating apparatus according to the present invention, the processed product is moved in the plating solution in a stable posture, and therefore, it is possible to continuously electroplate only the portion soaked in the plating solution without any other portion being covered by an insulating layer.

In addition, since the electrodes are provided in a place that is not soaked in the plating solution, it is possible to partially plate the processed product cleanly without leaving an electrode trace on the processed product.

BRIEF DESCRIPTION OF THE DRAWINGS

FIG. 4 is a partial cross-sectional view from the front side of the embodiment of FIG. 1 showing a processed product supported.

FIG. 5 is a partial side view of processed products like the processed product of FIG. 4 showing a state in which the processed products are pushed and moved on a pair of rails by rods.

FIG. 6 is a front view of the processed product of FIG. 4 showing a state in which the processed product is pushed and moved on the pair of rails.

DESCRIPTION OF THE PREFERRED EMBODIMENT

The preferred embodiment is now described by referring to the figures.

Figure 1:
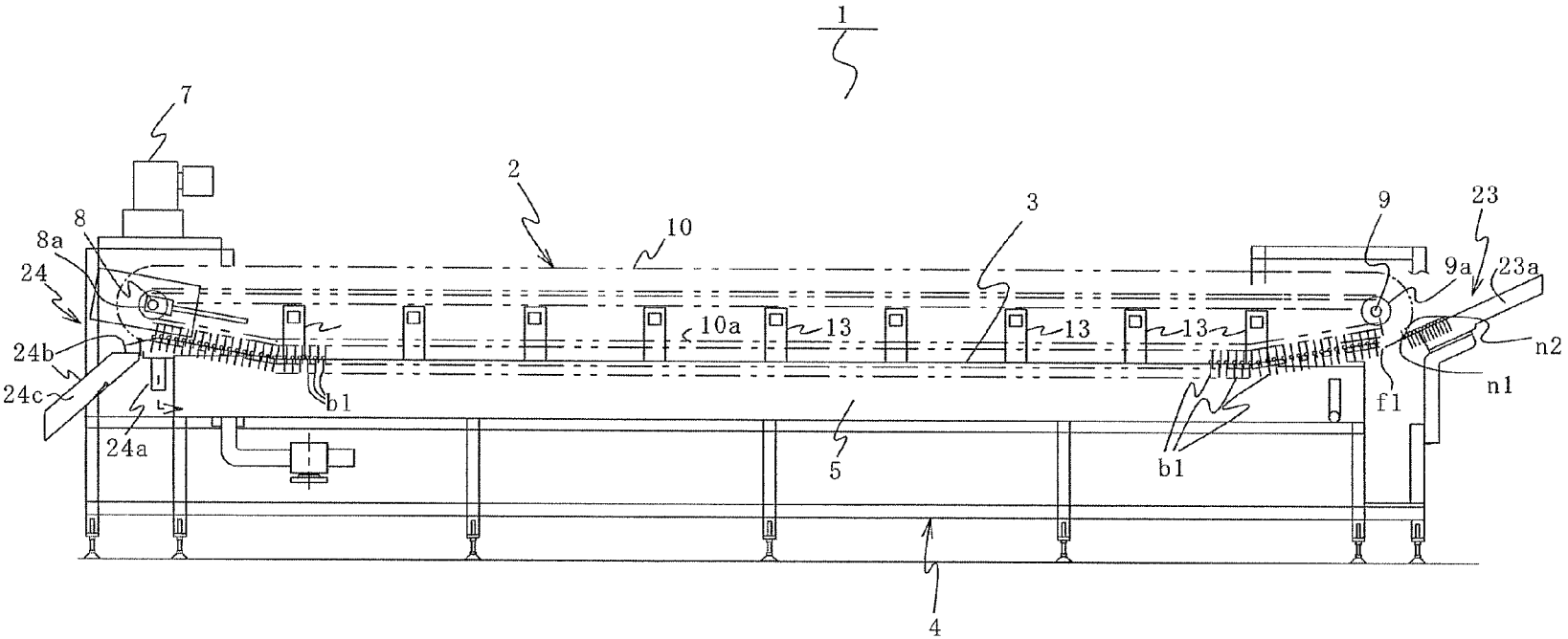
FIG. 1 is a side view of an electroplating apparatus according to an embodiment of the present invention.

In FIG. 1, an electroplating apparatus 1 of this embodiment includes a plating bath 5, a feeder device 2 arranged over the plating bath 5, and a pair of rails 3 for guiding processed products b1.

The electroplating apparatus 1 plates processed products b1, one of which is illustrated in FIG. 4. A processed product b1 has a head b10, a lower part b01 and a constricted part b03. In this embodiment, the head b10 is a partial spherical object, the lower part b01 is formed in a bolt shape, and the constricted part b03 is formed therebetween. The lower part b01 corresponds to a range or region to be plated, being provided with a section b11 to which a rotating-operating force is applied by a wrench, etc. and a male screw part b12. The head b10 is not plated. The center of gravity b02 of the processed product b1 is present in a slightly upper part of the section b11 of the lower part b01.

The processed product b1 is a machine part in which the head b10 is made up of a sliding surface like a joint. Rust-proofing is performed on the lower part b01 by plating, whereas the sliding surface is not plated to prevent the plating from peeling off and scattering.

In FIG. 1, the electroplating apparatus 1 has the plating bath 5 positioned on a frame 4. The feeder device 2 has a driving unit 7, a driving shaft 8, a driven shaft 9, driving-side sprockets 8*a*, driven-side sprockets 9*a* and endless chain belts 10.

Figure 2:
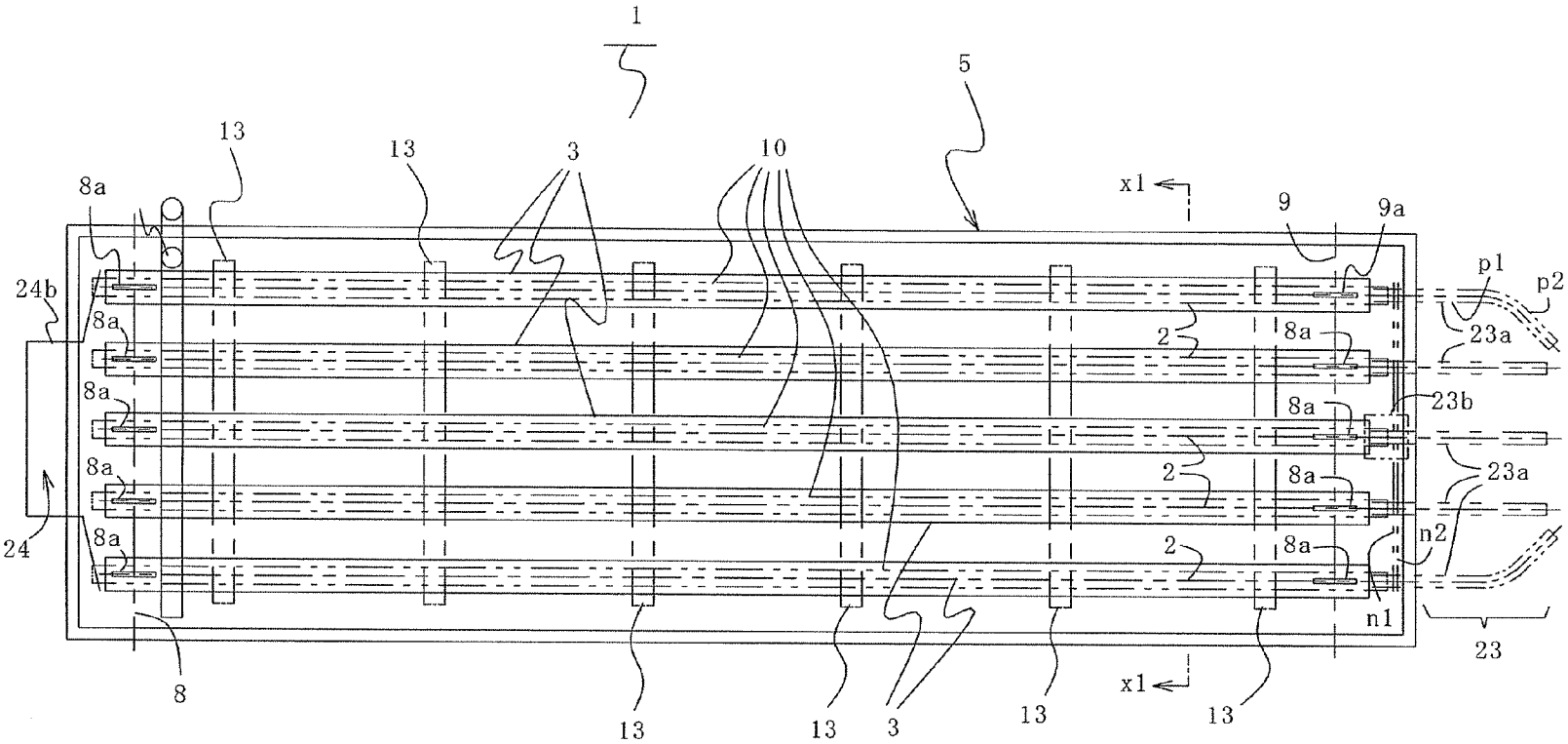
FIG. 2 is a plan view of the electroplating apparatus according to the above mentioned embodiment.

Five driving-side sprockets 8*a* are provided (see FIG. 2) and are respectively fixed spaced from one another along the length of the driving shaft 8. Five driven-side sprockets 9*a* are provided and are respectively fixed spaced from one another along the length of the driven shaft 9 at positions that correspond to the positions of the driving-side sprockets 8*a*.

Figure 3:
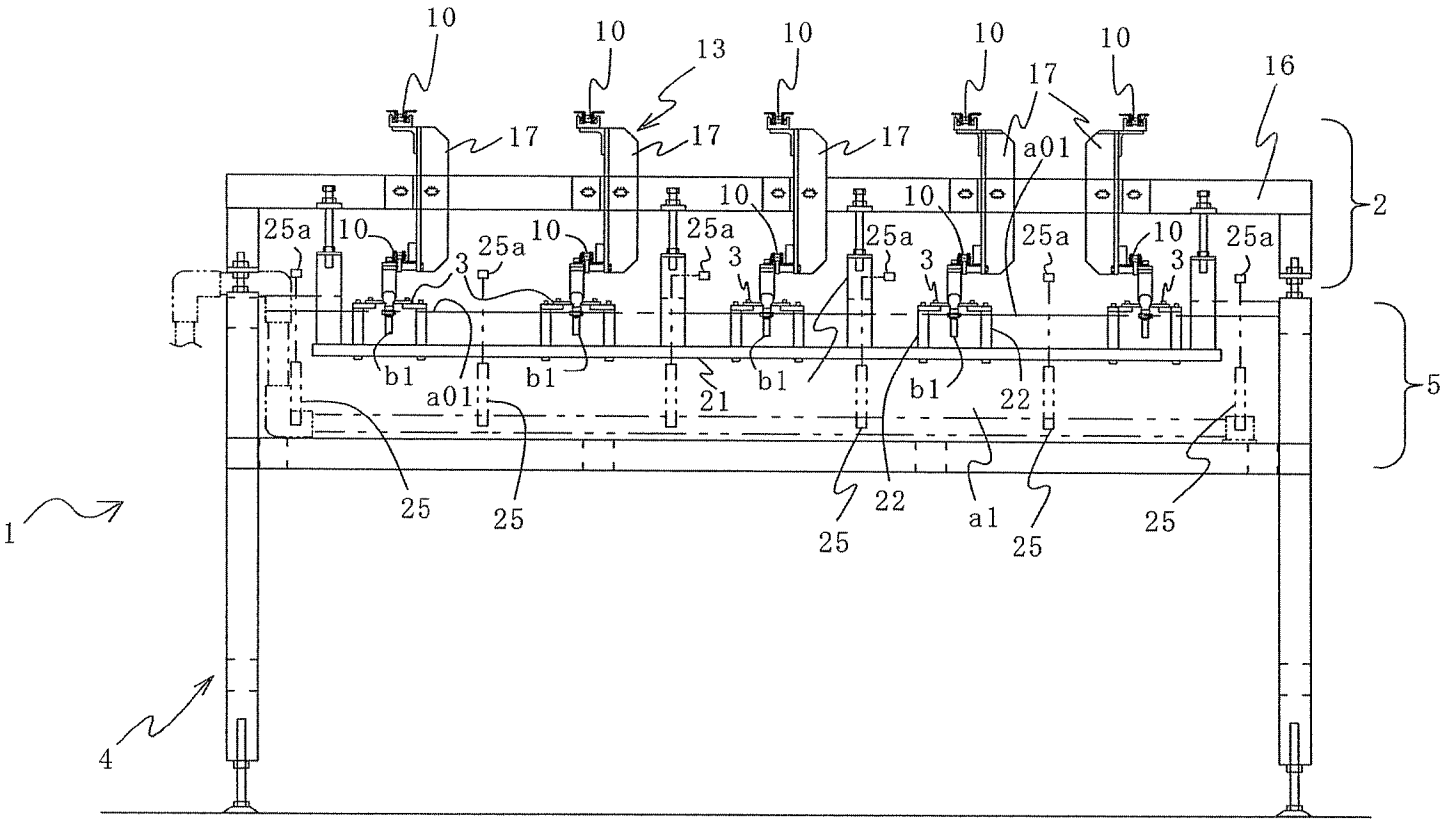
FIG. 3 is a cross-sectional view taken along the line x1-x1 of FIG. 2.

Each of the endless chain belts 10 is set on a pair of sprockets comprising one of the driving-side sprockets 8*a* and the corresponding one of the driven-side sprockets 9*a*, moving around along chain guiding frames 13 arranged discretely at intervals. In FIG. 3, each of the chain guiding frames 13 is so constructed that chain guides 17 are installed on double housing type frames 16 that extend in a perpendicular direction to the endless chain belts 10.

Each of the endless chain belts 10 is so constructed that unit links 14 are connected by pins 15 as shown in FIG. 5. As shown in FIG. 6, each of the unit links 14 is formed from a pair of right and left of link plates 14*a*, 14*b* and rollers 14*c* for keeping a fixed interval between the link plates. Outer circumferential edges of each of the link plates 14*a*, 14*b* are extended laterally by bending at an angle of 90 degrees to form horizontal plane parts d2, d1.

Each of the chain guides 17 includes regulatory bodies 17*b*, 17*c*. Each of the regulatory bodies 17*b*, 17*c* is engaged with one of the endless chain belts 10 so as to regulate lateral movement and downward movement and so as to allow longitudinal movement. The lower regulatory body 17*c* is provided with a horizontal supporting surface e1 for maintaining the level of each of the unit links 14 by supporting the horizontal plane part d1 of the unit link 14 and with a regulatory body e2 for preventing the horizontal plane part d1 from separating upwardly from the horizontal supporting surface e1.

Each of the endless chain belts 10 has pushing elements or rods 18 to provide pressure on the processed product b1. Each of the rods 18 is formed in a long slender plate shape made of a non-conductive material such as a synthetic resin material and fixed on the horizontal plane part d2 of the unit link 14 in a manner projecting toward the outside of the endless chain belt 10.

The pair of rails 3 is positioned along and under each of the endless chain belts 10 at a height proximate to the height of the upper periphery of the plating bath 5. The pair of rails includes long slender supporting plates 19, 19 and electrodes 20, 20. Here, the electrodes 20, 20 are made from long slender copper plates having smooth surfaces to be fixed to the supporting plates 19, 19. The supporting plates 19, 19 are fixed to the double housing type frames 16. The space between the rails 3 is wider than the dimension of the constricted part b03 but narrower than the dimension of the head b10. In the present embodiment, the interval is determined by the electrodes 20, 20, which have a narrower interval than the other parts of the rails.

In FIG. 1, a feed section 23 for the processed products b1 is formed to the rear of each of the endless chain belts 10 (the right side of FIG. 1), and an ejecting section 24 for the processed products b1 is formed at the front of each of the endless chain belts.

The feeder section 23 includes guidance rails 23*a*, on which processed products b1 are moved into a state with the heads b10 at the top, and on-off shutter plates n1, n2, which cause a plurality of processed products b1 on each of the guidance rails 23*a* to slide down one by one to a position corresponding to a starting point f1 of each of the pairs of rails 3. The on-off shutter plate n2 is positioned to the rear of the on-off shutter plate n1. Each of the guidance rails 23*a* has a pair of right and left supporting members p1, p2 (see FIG. 2), and the interval between the right and left supporting members is equal to the interval between the pair of rails 3. The guidance rails 23*a* slope downward toward the rails 3, and the interval between the supporting members p1, p2 continues to the interval between the rails 3. Therefore, the processed products b1 slip down from the guidance rails 23*a* to the rails 3 by gravity to be transferred to the rails 3.

The ejecting section 24 includes a liquid receiving part 24*a*, an extension rail 24*b* extended so as to slope downward in the direction of movement of each of the endless chain belts 10, and a chute 24*c* to guide the processed products b1 in an anteroinferior direction under the extension rail 24*b*.

A plurality of pole plates 25 made of plated metal as illustrated in FIG. 3 are arranged in a longitudinal line in the plating bath 5, immersed in the electrolyte solution a1 and connected to an anode 25*a* of a power source.

Next, a function of the electroplating apparatus of the above-mentioned embodiment will be explained.

A free liquid level a01 of the electrolyte solution a1 in the plating bath 5 is so made that the lower part b01 of the processed product b1 supported by each of the rails 3 is immersed in the electrolyte solution a1. Under this condition, each of the endless chain belts 10 is displaced in an orbit on a fixed moving path by operating the driving unit 7.

When the processed products b1 are deposited on the guidance rails 23*a* under this condition, they are received by the anterior on-off shutter plate n1 in its closed position, and they stand in a row. Next, when the on-off shutter plate n1 is displaced to an opened position, the processed product b1 at the front of the row is received by the on-off shutter plate n2. When the on-off shutter plate n1 is turned to the closed position, and the on-off shutter plate n2 is displaced to the opened position, the processed product b1 at the front of the row slips down to the starting point f1 of the pair of rails 3. The processed products b1 are fed between the rods 18 one by one by moving the on-off shutter plates n1, n2 so as to synchronize the interval between the rods 18.

Each of the processed products b1 stands naturally due to gravity because it is supported in a state in which the head b10 is supported by the supporting plates 19, 19 of the pair of rails 3 at the starting point f1, and the center of gravity is at a position that is lower than the supported position. The rod 18 extends from above the pair of rails 3, through the opening between the supporting plates 19, to below the rails 3, contacting the section b11 of the center of gravity b02 from the back. The processed product b1 is displaced on the rails 3 by pushing the contacted position (see FIG. 5).

Thereafter, by repeatedly operating the feeder section 23, the processed products b1 are respectively positioned between a pair of adjacent rods 18, 18 on each of the endless chain belts 10 and between the corresponding right and left electrodes 20, 20 of the pair of rails 3. Thus, each of the processed products b1 enters a state in which right and left portions of the constricted part b03 are supported by the electrodes 20, 20. Under this condition, the processed products b1 are slipped and displaced on the electrodes 20, 20 by the pressure of the contacting rods 18 from the rear. During the displacement, the processed products b1 begin to soak in the electrolyte solution a1 in the plating bath 5.

As is illustrated in FIG. 4, the processed product enters a state in which the lower part b01 is immersed in the electrolyte solution a1. Thereafter, each of the processed products b1 is further displaced along the rails 3 by the pressure from the rods 18.

Then, the processed products b1 are pulled up from the electrolyte solution a1 in the plating bath 5 to the air, thereafter arriving at the ejecting section 24 over a liquid receiving section 5*d*.

The center of gravity b02 of the processed product b1 is under the pair of rails 3, and the rod 18 contacts the section 11*a* little below the center of gravity b02 to push the processed product. Accordingly, the processed product b1 can be displaced while keeping its orientation, because the rod 18 extends from over the rails 3 and contacts the head b10 of the processed product b1 which is going to break the posture even if the head b10 is about to reject the displacement by friction between the electrodes 20, 20. On the other hand, the processed product b1 is stably displaced on the rails 3 with a proper standing orientation, without only the head b10 pushed forward, because a lower position is pushed more to some extent than the center of gravity b02. Accordingly, it is possible to avoid plating deposition on an unintended portion.

On the other hand, while the processed product b1 pushed and displaced by the feeder device 2 is immersed in the electrolyte solution a1 of the plating bath 5, the processed product b1 is given cathode electric potential, and the pole plate 25 is given anode electric potential through the electrodes 20, 20. Accordingly, the portion immersed in the electrolyte solution a1 of the processed product b1 receives a deposit of metal plate. In this case, it is possible to avoid electrolytic nonuniformity caused by the uneven distribution of pole plate 25 and to prevent surface irregularity, because the processed product b1 is displaced in a state in which the lower part b01 is immersed in the electrolyte solution a1.

In addition, the electrode 20 is not affected by the plating solution because it is in the air. Therefore, it is possible to select and use good conductive metal, and besides, no electrode trace is left on the processed product b1.

When the processed product b1 passes through an anterior slope undercoat portion 10*a*, it does not receive pressure from the rod 18. However, the processed product b1 is pushed by a following processed product b1, which is pushed and displaced by the guide action of the extension rail 24*b* and the pressure from the rod 18, sliding down forward and downward, then falling onto the chute 24*c*. The chute 24*c* makes the processed products b1 slide down a further anteroinferior storage space.

Thus, the present embodiment is effective in stably carrying out continuous partial plating even without covering the head 10.

In the above-mentioned embodiment, although one processed product b1 is pushed and displaced by one rod 18, a plurality of processed products b1 (for example, three) can be slid down on the guide starting point f1 at one time by extending the distance between the rods 18, 18 and widening the interval between the on-off shutter plates n1, n2.

In the above-mentioned embodiment, the constricted part b03 of the processed product b1 is narrower in width than the head b10 and the lower part b01. However, the head b10 should be supported on the rails 3, and therefore, the constricted part b03 means that it is constricted from the head b10 and does not need constricting from the lower part b01. Accordingly, the constricted part b03 may be broader than the lower part b01. Although the rod 18 is formed in a long slender plate shape in the above-mentioned embodiment, it should be at least formed in a shape that can, during contact with the processed product b1, push the portion a little below the center of gravity of the processed product b1 and, when the head of the processed product is going to change orientation, push the head at a portion above the rails 3.

DESCRIPTION OF THE REFERENCE NUMERAL

1 electroplating apparatus
2 feeder device
3 rail
5 plating bath
10 endless chain belt
18 rod
20 electrode
a1 electrolyte solution
b1 processed product
b10 head
b02 center of gravity
b03 constricted part
b01 lower part

What is claimed is:

1. An electroplating apparatus for electroplating a portion of each of a plurality of processed products other than a head of the processed products, the processed products each having the head, a lower part and a constricted part between the head and the lower part, the processed products each also having a center of gravity at the lower part, the electroplating apparatus comprising:

a pair of stationary rails having an opening between the stationary rails narrower than the head and broader than the constricted part and including electrodes arranged thereon;

a plating bath positioned below the stationary rails and having electrode plates arranged in a plating solution in the bath;

a feeder device to arrange the processed products such that the constricted part is placed in the opening between the stationary rails, the head is positioned above the pair of stationary rails, and the lower part is positioned below the pair of stationary rails; and pushing elements passing through the opening of the pair of stationary rails from above the pair of stationary rails and sliding the processed products on the pair of stationary rails, in contact with the electrodes, by contacting and pushing each of the processed products at a position lower than the center of gravity of the processed product, each of the pushing elements being a separate piece from a corresponding processed product.

2. An electroplating method for electroplating a portion of each of a plurality of processed products other than a head of the processed products, the processed products each having the head, a lower part and a constricted part between the head and the lower part, the processed products each also having a center of gravity at the lower part, the electroplating method comprising:

providing a pair of stationary rails having an opening between the stationary rails narrower than the head and broader than the constricted part and including electrodes arranged thereon;

providing a plating bath below the pair of stationary rails, said plating bath having electrode plates arranged in a plating solution in the bath;

feeding the processed products into a feeder device to place the constricted part in the opening between the stationary rails in a state in which the head is positioned above the pair of stationary rails and the lower part is positioned below the pair of stationary rails;

sliding and displacing the processed products on the pair of stationary rails, in contact with the electrodes, by contacting and pushing each of the processed products at a position lower than the center of gravity of the processed products by pushing elements, each of the pushing elements being a separate piece from a corresponding process product; and partially electroplating the processed products in a state in which the lower part is immersed in plating solution.

* * * * *